US008011475B2

(12) United States Patent
Wang

(10) Patent No.: US 8,011,475 B2
(45) Date of Patent: Sep. 6, 2011

(54) LADDER

(75) Inventor: Kecheng Wang, Tianjin (CN)

(73) Assignee: Tianjin Kelin Mold Technic Co., Ltd., Tianjin (CN)

( * ) Notice: Subject to any disclaimer, the term of this patent is extended or adjusted under 35 U.S.C. 154(b) by 5 days.

(21) Appl. No.: 12/623,464

(22) Filed: Nov. 23, 2009

(65) Prior Publication Data

US 2010/0133041 A1 Jun. 3, 2010

Related U.S. Application Data

(63) Continuation of application No. PCT/CN2007/070226, filed on Jul. 3, 2007.

(30) Foreign Application Priority Data

May 22, 2007 (CN) ..... 2007 1 0057415

(51) Int. Cl.
*E06C 1/12* (2006.01)

(52) U.S. Cl. ..... 182/195; 182/228.1; 182/228.3; 182/228.4; 182/228.5; 182/228.6; 182/229

(58) Field of Classification Search ..... 182/195, 182/228.1, 228.3, 228.4, 228.5, 228.6, 229
See application file for complete search history.

(56) References Cited

U.S. PATENT DOCUMENTS

| | | | | |
|---|---|---|---|---|
| 2,649,971 | A * | 8/1953 | Marchand | 211/123 |
| 2,975,857 | A * | 3/1961 | Suroff et al. | 182/166 |
| 2,982,373 | A * | 5/1961 | Hopfeld | 182/228.6 |
| 4,086,980 | A * | 5/1978 | Shortes et al. | 182/151 |
| 4,119,177 | A * | 10/1978 | Andersson | 182/195 |
| 4,989,692 | A * | 2/1991 | Min | 182/166 |
| 5,156,234 | A * | 10/1992 | McCallum et al. | 182/46 |
| 5,738,186 | A * | 4/1998 | Jones | 182/195 |
| 7,316,293 | B2 * | 1/2008 | Yao et al. | 182/195 |
| 2009/0050407 | A1 * | 2/2009 | Eriksson | 182/195 |
| 2010/0258379 | A1 * | 10/2010 | Mickens | 182/111 |
| 2010/0270106 | A1 * | 10/2010 | Chen | 182/195 |
| 2010/0307870 | A1 * | 12/2010 | Zimmerman | 182/195 |

* cited by examiner

*Primary Examiner* — Alvin C Chin-Shue
*Assistant Examiner* — Colleen M Quinn
(74) *Attorney, Agent, or Firm* — Matthias Scholl P.C.; Matthias Scholl

(57) ABSTRACT

An extension ladder, including multiple ladder sections, each including a pair of pin holes, a pair of columns, and a rung, including a pair of pins, a pair of springs, a gear, a pair of gear racks, and a pair of mounting rings, wherein the columns of adjacent ladder sections are fit with each other, diameters of the columns of the ladder sections increase from the top to the bottom, the pin holes are disposed on the columns, and operate to receive the pins, the pins are coaxial, the gear is disposed on a side wall of the rung and engaged with the gear rack, one end surface of the gear sticks out from the side wall of the rung, a key hole is disposed on the end surface of the gear, the mounting ring operates to fix the pin, and the spring is contacted with the pin.

6 Claims, 22 Drawing Sheets

LADDER

CROSS-REFERENCE TO RELATED APPLICATIONS

This application is a continuation of International Patent Application No. PCT/CN2007/070226 with an international filing date of Jul. 3, 2007, designating the United States, now pending, and further claims priority benefits to Chinese Patent Application No. 200710057415.2 filed on May 22, 2007. The contents of all of the aforementioned applications, including any intervening amendments thereto, are incorporated herein by reference

BACKGROUND OF THE INVENTION

1. Field of the Invention

The invention relates to a ladder, a combined ladder and a step ladder, and more particularly to an extension ladder, a combined extension ladder and a step ladder.

2. Description of the Related Art

Extension ladders, combined extension ladders and step ladders are widely used nowadays. However, there are several problems with them: firstly, they have complex structure, single functions, and poor extension performance; secondly, they are difficult to be combined; finally, they lack safety and incorrect operation thereof often hurt operators.

SUMMARY OF THE INVENTION

In view of the above-described problem, it is one objective of the invention to provide an extension ladder that features a simple structure, complete functions, and good extension performance, and is safe for use.

It is another objective of the invention to provide a combined extension ladder that features a simple structure, complete functions, and good extension and combination performance, and is safe for use.

It is a further objective of the invention to provide a step ladder that features a simple structure, complete functions, and good extension and combination performance, and is safe for use.

To achieve the above objectives, in accordance with one embodiment of the invention, provided is an extension ladder, comprising multiple ladder sections, each comprising a pair of pin holes, a pair of columns, and a rung, comprising a pair of pins, a pair of springs, a gear, a pair of gear racks, and a pair of mounting rings, wherein the columns of adjacent ladder sections are fit with each other, diameters of the columns of the ladder sections increase from the top to the bottom, the pin holes are disposed on the columns, and operate to receive the pins, the pins are coaxial, the gear is disposed on a side wall of the rung and engaged with the gear rack, one end surface of the gear sticks out from the side wall of the rung, a key hole is disposed on the end surface of the gear, the mounting ring operates to fix the pin, and the spring is contacted with the pin.

In a class of this embodiment, the gear racks drive the pins to move as the gear rotates.

In accordance with another embodiment of the invention, provided is an extension ladder, comprising multiple ladder sections, each comprising a pair of pin holes, a pair of columns, and a rung, comprising a pair of pins, a pair of springs, a wheel, a pair of soft belts, and a pair of mounting rings, wherein the columns of adjacent ladder sections are fit with each other, diameters of the columns of the ladder sections increase from the top to the bottom, the pin holes are disposed on the columns, and operate to receive the pins, the pins are coaxial, one end of the soft belt is disposed on the wheel, the mounting ring is disposed on the other end of the soft belt and operates to fix the pin, the wheel is disposed on a side wall of the rung, one end surface of the wheel sticks out from the side wall of the rung, a key hole is disposed on the wheel, and the spring is contacted with the pin.

In a class of this embodiment, the soft belts drive the pins to move as the wheel rotates.

In accordance with still another embodiment of the invention, provided is a combined extension ladder, comprising multiple extension ladders, comprising multiple ladder sections, each comprising a pair of pin holes, a pair of columns, and a rung, comprising a pair of pins, a pair of springs, a gear, a pair of gear racks, and a pair of mounting rings, multiple connecting shafts, wherein the columns of adjacent ladder sections are fit with each other, diameters of the columns of the ladder sections increase from the top to the bottom, the pin holes are disposed on the columns, and operate to receive the pins, the pins are coaxial, the gear is disposed on a side wall of the rung and engaged with the gear rack, one end surface of the gear sticks out from the side wall of the rung, a key hole is disposed on the end surface of the gear, the mounting ring operates to fix the pin, the spring is contacted with the pin, and adjacent extension ladders are connected to each other by threaded-connecting the columns to the connecting shafts.

In accordance with a further embodiment of the invention, provided is a combined extension ladder, comprising multiple extension ladders, comprising multiple ladder sections, each comprising a pair of pin holes, a pair of columns, and a rung, comprising a pair of pins, a pair of springs, a wheel, a pair of soft belts, and a pair of mounting rings, multiple connecting shafts, wherein the columns of adjacent ladder sections are fit with each other, diameters of the columns of the ladder sections increase from the top to the bottom, the pin holes are disposed on the columns, and operate to receive the pins, the pins are coaxial, one end of the soft belt is disposed on the wheel, the mounting ring is disposed on the other end of the soft belt and operates to fix the pin, the wheel is disposed on a side wall of the rung, one end surface of the wheel sticks out from the side wall of the rung, a key hole is disposed on the wheel, the spring is contacted with the pin, and adjacent extension ladders are connected to each other by threaded-connecting the columns to the connecting shafts.

In accordance with a still further embodiment of the invention, provided is a step ladder, comprising multiple extension ladders, comprising multiple ladder sections, each comprising a pair of pin holes, a pair of columns, and a rung, comprising a pair of pins, a pair of springs, a gear, a pair of gear racks, and a pair of mounting rings, multiple connecting shafts, multiple beams, wherein the columns of adjacent ladder sections are fit with each other, diameters of the columns of the ladder sections increase from the top to the bottom, the pin holes are disposed on the columns, and operate to receive the pins, the pins are coaxial, the gear is disposed on a side wall of the rung and engaged with the gear rack, one end surface of the gear sticks out from the side wall of the rung, a key hole is disposed on the end surface of the gear, the mounting ring operates to fix the pin, the spring is contacted with the pin, one of the extension ladders operates as a platform, and the platform is connected to other extension ladders via the connecting shafts and the beams.

In a class of this embodiment, a pair of sleeves is disposed on both ends of the beam, and the sleeve comprises a first sleeve and a second sleeve.

In a class of this embodiment, the second sleeves on both ends of the beam are aligned with and fit to the columns of the platform, and the platform is connected to other extension ladders via the connecting shafts.

In a class of this embodiment, a pedal is disposed on the platform.

In accordance with a still further embodiment of the invention, provided is a step ladder, comprising multiple extension ladders, comprising multiple ladder sections, each comprising a pair of pin holes, a pair of columns, and a rung, comprising a pair of pins, a pair of springs, a wheel, a pair of soft belts, and a pair of mounting rings, multiple connecting shafts, multiple beams, wherein the columns of adjacent ladder sections are fit with each other, diameters of the columns of the ladder sections increase from the top to the bottom, the pin holes are disposed on the columns, and operate to receive the pins, the pins are coaxial, one end of the soft belt is disposed on the wheel, the mounting ring is disposed on the other end of the soft belt and operates to fix the pin, the wheel is disposed on a side wall of the rung, one end surface of the wheel sticks out from the side wall of the rung, a key hole is disposed on the wheel, the spring is contacted with the pin, one of the extension ladders operates as a platform, and the platform is connected to other extension ladders via the connecting shafts and the beams.

In a class of this embodiment, a pair of sleeves is disposed on both ends of the beam, and the sleeve comprises a first sleeve and a second sleeve.

In a class of this embodiment, the second sleeves on both ends of the beam are aligned with and fit to the columns of the platform, and the platform is connected to other extension ladders via the connecting shafts.

In a class of this embodiment, a pedal is disposed on the platform.

In accordance with a still further embodiment of the invention, provided is a step ladder, comprising a pair of legs, each comprising multiple extension ladders, comprising multiple ladder sections, each comprising a pair of pin holes, a pair of columns, and a rung, comprising a pair of pins, a pair of springs, a gear, a pair of gear racks, and a pair of mounting rings, multiple connecting shafts, a supporting plate, a hinge, wherein the columns of adjacent ladder sections are fit with each other, diameters of the columns of the ladder sections increase from the top to the bottom, the pin holes are disposed on the columns, and operate to receive the pins, the pins are coaxial, the gear is disposed on a side wall of the rung and engaged with the gear rack, one end surface of the gear sticks out from the side wall of the rung, a key hole is disposed on the end surface of the gear, the mounting ring operates to fix the pin, the spring is contacted with the pin, adjacent extension ladders are connected to each other by threaded-connecting the columns to the connecting shafts, the legs are connected to each other via the hinge, and the supporting plate is disposed between the rungs of topmost extension ladders of the legs.

In a class of this embodiment, a pair of spiral ladder butts, antiskid ladder butts, or widening ladder butts is disposed at the bottom of the columns of downmost extension ladders of the legs.

In accordance with a still further embodiment of the invention, provided is a step ladder, comprising a pair of legs, each comprising multiple extension ladders, comprising multiple ladder sections, each comprising a pair of pin holes, a pair of columns, and a rung, comprising a pair of pins, a pair of springs, a wheel, a pair of soft belts, and a pair of mounting rings, multiple connecting shafts, a supporting plate, a hinge, wherein the columns of adjacent ladder sections are fit with each other, diameters of the columns of the ladder sections increase from the top to the bottom, the pin holes are disposed on the columns, and operate to receive the pins, the pins are coaxial, one end of the soft belt is disposed on the wheel, the mounting ring is disposed on the other end of the soft belt and operates to fix the pin, the wheel is disposed on a side wall of the rung, one end surface of the wheel sticks out from the side wall of the rung, a key hole is disposed on the wheel, the spring is contacted with the pin, adjacent extension ladders are connected to each other by threaded-connecting the columns to the connecting shafts, the legs are connected to each other via the hinge, and the supporting plate is disposed between the rungs of topmost extension ladders of the legs.

In a class of this embodiment, a pair of spiral ladder butts, antiskid ladder butts, or widening ladder butts is disposed at the bottom of the columns of downmost extension ladders of the legs.

Advantage of the invention comprise:

1) since a key is required to extend the ladder, a problem that incorrect operation may hurt operators is solved, and thus safety is greatly improved.

2) retraction of the ladder is very convenient, the operator only need to use one hand to turn the key, and another hand to retract the ladder section, and therefore the ladder of the invention can be operated by one operator only.

3) the ladder features improved functionality: as the ladder is extended, different kinds of ladder: such as an extension ladder, a combined extension ladder and a step ladder that fit for different climbing operations can be formed. A height of the ladder ranges from 1 to 7 m. As the invention is used as a step ladder, a height thereof can be adjusted in a range between 1 and 7 m, and a length of the platform can be adjusted in a range of 0.8 and 2.2 m.

4) the invention occupies small space during transportation or retraction, and can be received by two normal-sized suitcases after being retracted.

BRIEF DESCRIPTION OF THE DRAWINGS

The invention is described hereinafter with reference to accompanying drawings, in which:

FIG. 1-2 is a schematic view of a rung of the invention;

FIG. 1-3 is a schematic view of another rung of the invention;

FIG. 1-4 illustrates operation principle of the rungs in FIGS. 1-2 and 1-3;

FIG. 2 is a combined extension ladder of an exemplary embodiment of the invention;

FIG. 3-1 is a front view of a step ladder of an exemplary embodiment of the invention;

FIG. 3-2 is a front view of a pedal of the step ladder in FIG. 3-1;

FIG. 3-3 is a top view of a pedal of the step ladder in FIG. 3-1;

FIG. 3-4 is a schematic view of the step ladder in FIG. 3-1;

FIG. 3-5 is a top view of a connecting shaft of the step ladder in FIG. 3-1;

FIG. 3-6 is a front view of a connecting shaft of the step ladder in FIG. 3-1;

FIG. 4-1 is a front view of a step ladder of another exemplary embodiment of the invention;

FIG. 4-2 is a schematic view of the step ladder in FIG. 4-1;

FIGS. 5-1 to 5-8 show a spiral ladder butt and antiskid ladder butt of the invention.

FIG. 6 is a schematic view of a retracted step ladder.

100—extension ladder 101—column 102—rung 103—pinhole 105—pin 106—spring 108—key hole 109—gear 110—gear rack 111—wheel 112—soft belt 201—connecting shaft 300—widening ladder butt 401—platform 402—leg 403—beam 404—pedal 405—sleeve 406—first sleeve 407—second sleeve 501—ladder butt 502—hinge 503—supporting plate 600—spiral ladder butt

DETAILED DESCRIPTION OF THE EMBODIMENTS

Figure 1:
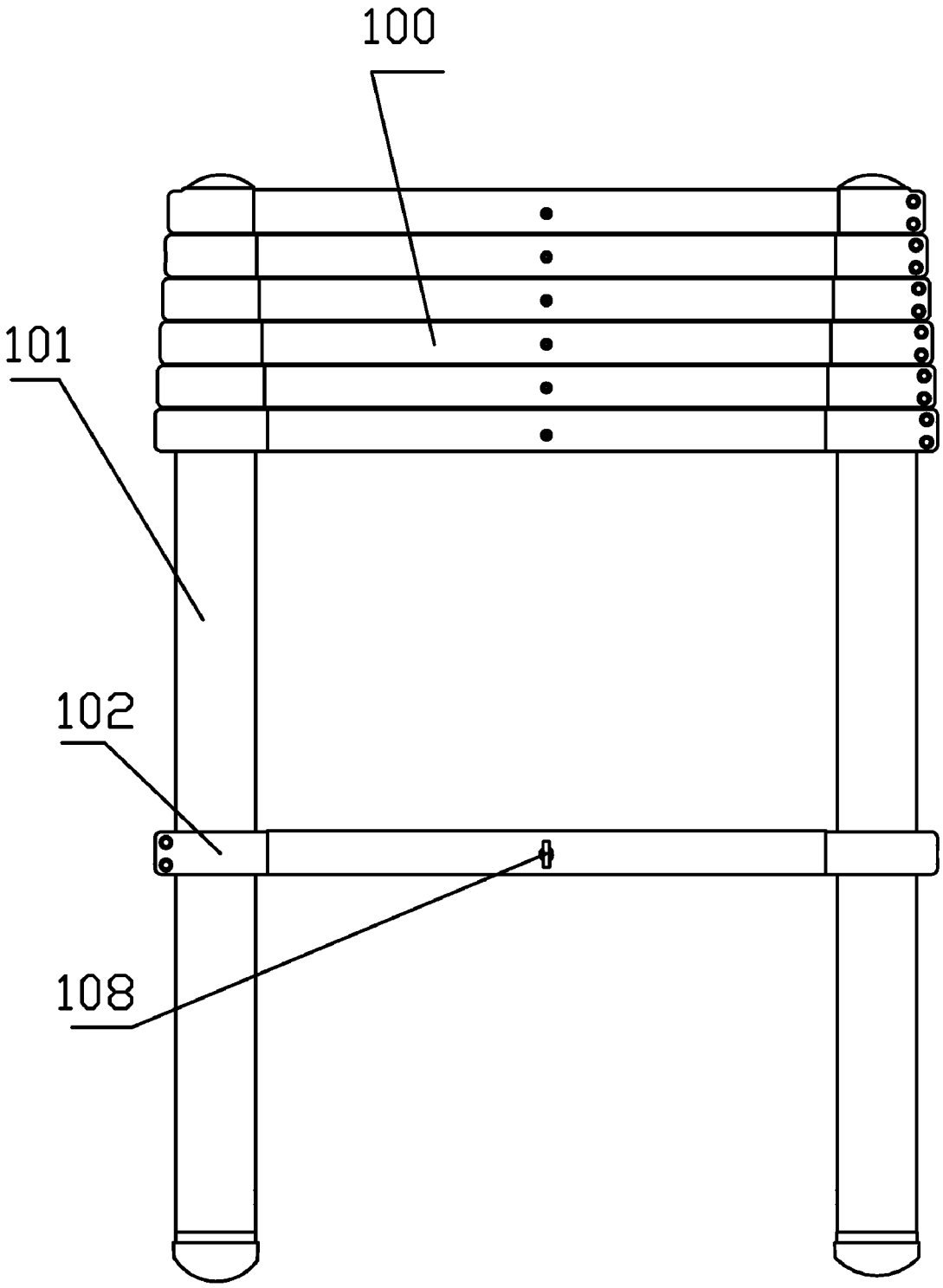
FIG. 1-1 is a schematic view of an extension ladder of an exemplary embodiment of the invention.

As shown in FIG. 1-1, an extension ladder 100 of the invention comprises multiple ladder sections. The ladder section comprises a pair of pin holes 103, a pair of columns 101, and a rung 102. The columns 101 of adjacent ladder sections are fit with each other, and diameters of the columns 101 of the ladder sections increase from the top to the bottom. The pin holes 103 are disposed on the columns 101.

Figures 1, 2:
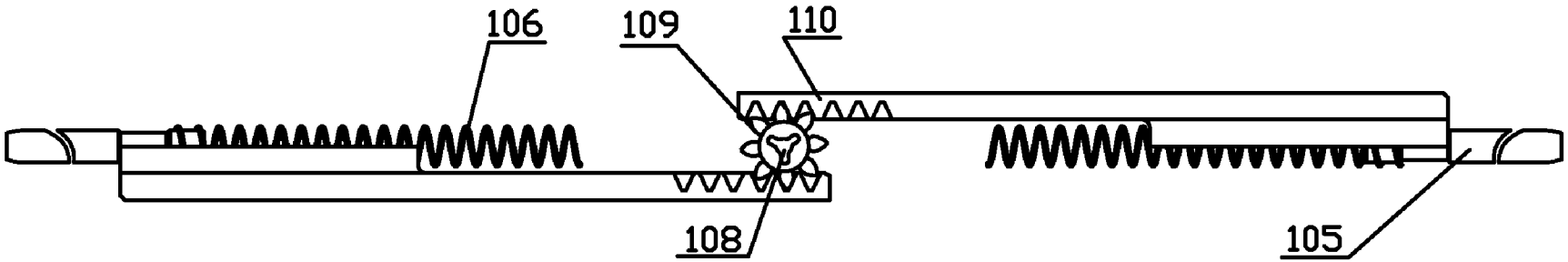

As shown in FIG. 1-2, the rung 102 of an embodiment of the invention comprises a pair of pins 105, a pair of springs 106, a gear 109, a pair of gear racks 110, and a pair of mounting rings. The pin holes 103 operate to receive the pins 105, and the pins 105 are coaxial.

The gear 109 is disposed on a side wall of the rung 102 and engaged with the gear rack 110.

One end surface 107 of the gear 109 sticks out from the side wall of the rung 102, and a key hole 108 is disposed on the end surface 107 of the gear 109.

The mounting ring operates to fix the pin 105.

The spring 106 is contacted with the pin 105.

As an operator turns a key, the gear 109 rotates, and the gear racks 110 drive the pins 105 to move out from the pin holes 103.

Figures 1, 2, 3:
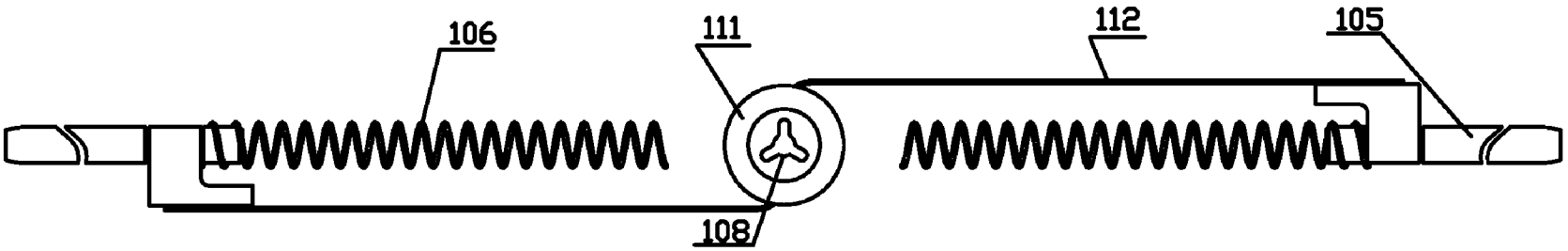

As shown in FIG. 1-3, the rung 102 of another embodiment of the invention comprises a pair of pins 105, a pair of springs 106, a wheel 111, a pair of soft belts 112, and a pair of mounting rings. The pin holes 103 operate to receive the pins 105, and the pins 105 are coaxial.

One end of the soft belt 112 is disposed on the wheel 111.

The mounting ring is disposed on the other end of the soft belt 112 and operates to fix the pin 105.

The wheel 111 is disposed on a side wall of the rung 102.

One end surface 107 of the wheel 111 sticks out from the side wall of the rung 102.

A key hole 108 is disposed on the wheel 111.

The spring 106 is contacted with the pin 105.

As an operator turns a key, the wheel 111 rotates, and the soft belt 112 moves and drives the pins 105 to move out from the pin holes 103.

As shown in FIG. 1-4, as a ladder section is pulled, under the action of the spring 106, the pin 105 is inserted in the pin hole 103, and thus the rung 102 is fixed to the column 101. As the ladder needs to be retracted, an operator inserts a key into the key hole 108 and turns the key so that the gear 109 or the wheel 111 rotates, at this time the gear rack 110 or the soft belt 112 drives the pins 105 to move out from the pin hole 103, and thus the ladder is retracted. Extension and retraction of the ladder can be done by only one operator, which is safe, reliable and high-efficient.

As shown in FIG. 2, a combined extension ladder of the invention comprises multiple extension ladders 100 and multiple connecting shafts 201. Adjacent extension ladders 100 are connected to each other by threaded-connecting the columns 101 to the connecting shafts 201. In this embodiment, the number of the ladder sections of the extension ladder 100 is 6. As a desired height is greater than a length of the six ladder sections, two or more extension ladders 100 can be combined via the connecting shafts 201. If three extension ladders 100 are combined, the maximum height of the combined extension ladder may be up to 7 m. As a height of the combined extension ladder is greater than 4 m, a widening ladder butt 300 is used for safety and stability.

As shown in FIG. 3-1, a step ladder of an embodiment of the invention comprises a platform 401, a pair of legs 402, multiple connecting shafts 201, and multiple beams 403. The leg 402 comprises multiple extension ladders 100. Another extension ladder 100 operates as a platform 401. The platform 401 is connected to the legs 402 via the connecting shafts 201 and the beams 403.

As shown in FIGS. 3-5 and 3-6, a pair of sleeves 405 is disposed on both ends of the beam 403, and each comprises a first sleeve 406 and a second sleeve 407. The first sleeve 406 is inclined with respect to the second sleeve 407.

Figures 1, 2, 3, 4:
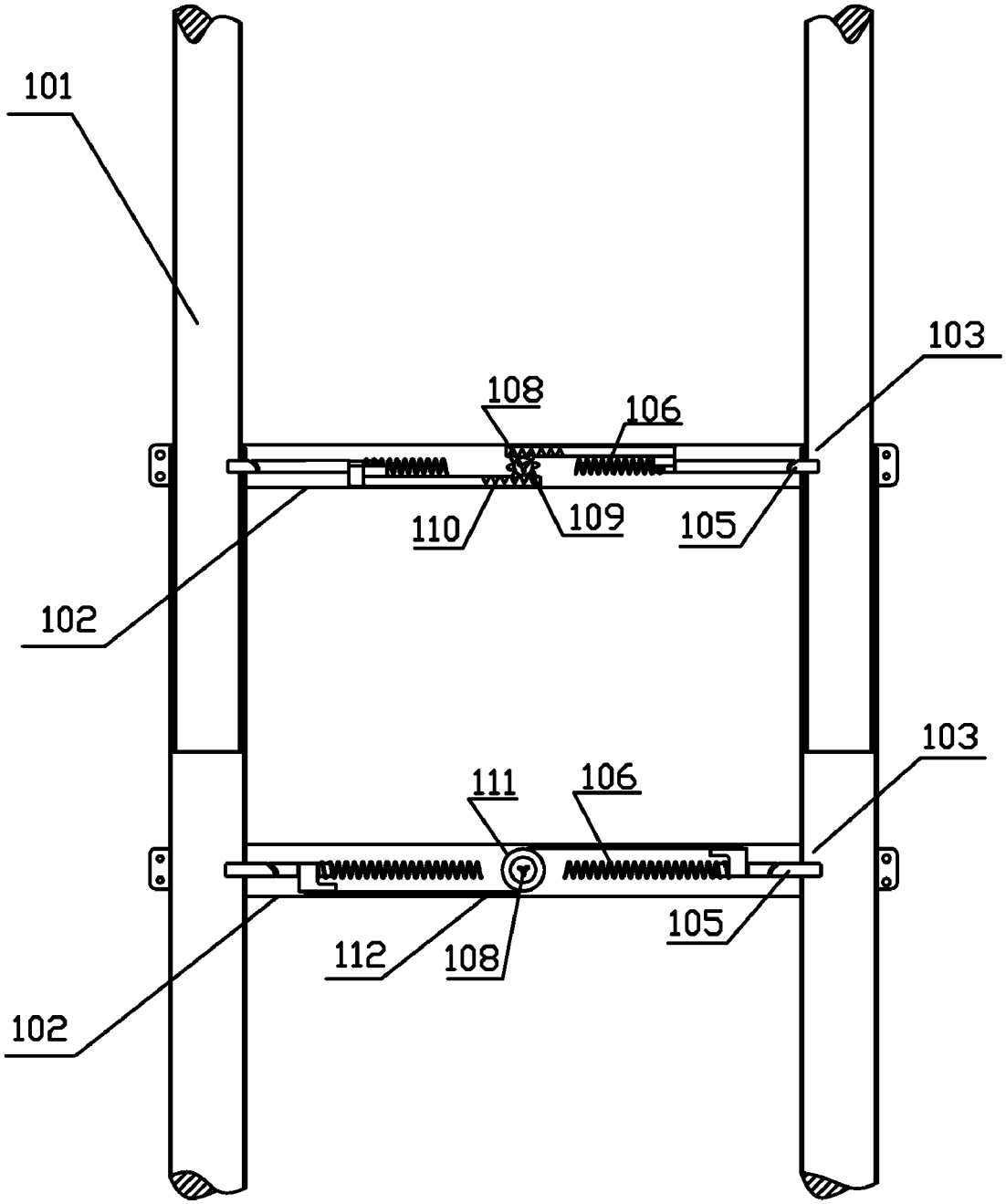
Figure 2:
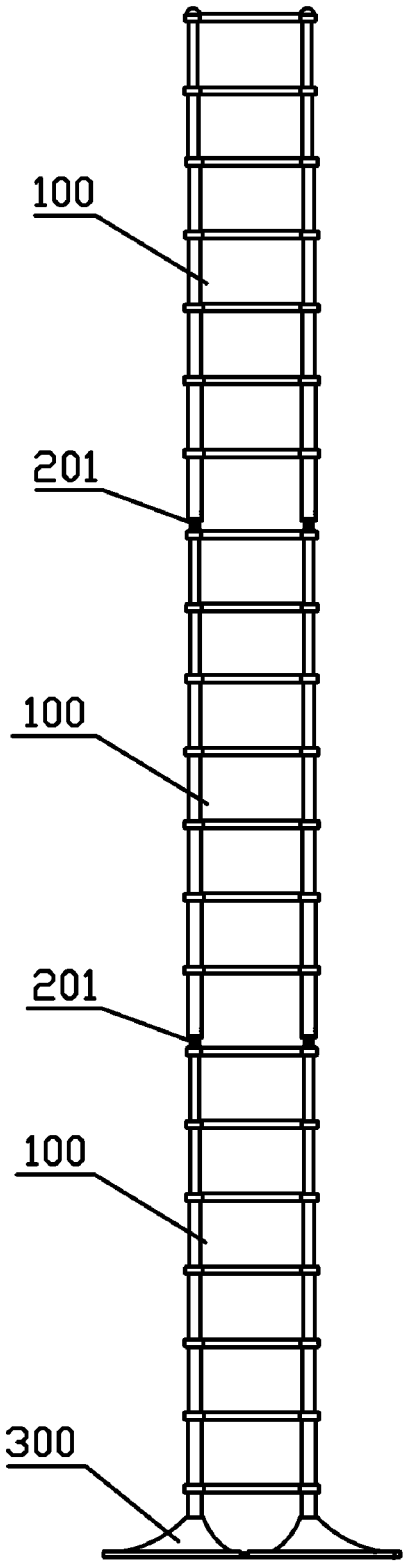

As shown in FIGS. 3-1 and 3-4, in this embodiment, two extension ladders 100 are used as the legs 402, and one extension ladder 100 is used as the platform 401. The platform 401 is connected to the legs 402 via the connecting shafts 201 and the beams 403. In details, the second sleeves 407 on both ends of the beam 403 is aligned with and fit to the columns 101, and then the legs 402 are fixed to the platform 401 via the connecting shafts 201. For safety and stability, a widening ladder butt 300 can be used.

As shown in FIGS. 3-2 and 3-3, multiple pedals 404 with the same structure are disposed on the platform 401. Multiple hooks are staggered disposed on both sides of the pedal 404. In this embodiment, two hooks are disposed on one side of the pedal 404, and three hooks are on the other side thereof. During installation, hooks of adjacent pedals 404 are crossingly fixed on the rung 102 of the platform 401. The number of the pedals 404 is dependent on specific working condition, and a length of the platform 401 can be adjusted in a range between 0.8 and 2.2 m.

A height of the step ladder can be varied by adjusting a height of the leg 402.

If the ground is not even enough, a spiral ladder butt 600 can be added to the bottom of the ladder butt.

Heights of the platform 401 and the leg 402 can be adjusted by retracting or extending the ladder section.

The leg 402 can be formed by multiple extension ladders 100, and a height of the step ladder ranges from 1 to 7 m.

As shown in FIGS. 4-1 and 4-2, a step ladder of another embodiment of the invention comprises a pair of legs 501, a hinge 502, and a supporting plate 503. The leg 501 comprises multiple extension ladders 100.

The legs 501 are connected to each other via the hinge 502.

The supporting plate 503 is disposed between the rungs 102 of topmost extension ladders 100 of the legs 502.

Multiple pin holes are disposed on two sub-legs of the hinge 502. As the sub-legs of the hinge 502 are inserted into the legs 501, the pins 105 in the upmost rungs 102 fix the hinge 502, whereby connecting the legs 501.

A height of the step ladder can be adjusted by retracting or extending the ladder section.

If the ground is not even enough, a height of any of the extension ladder 100 can be adjusted for stability.

Figures 1, 3:
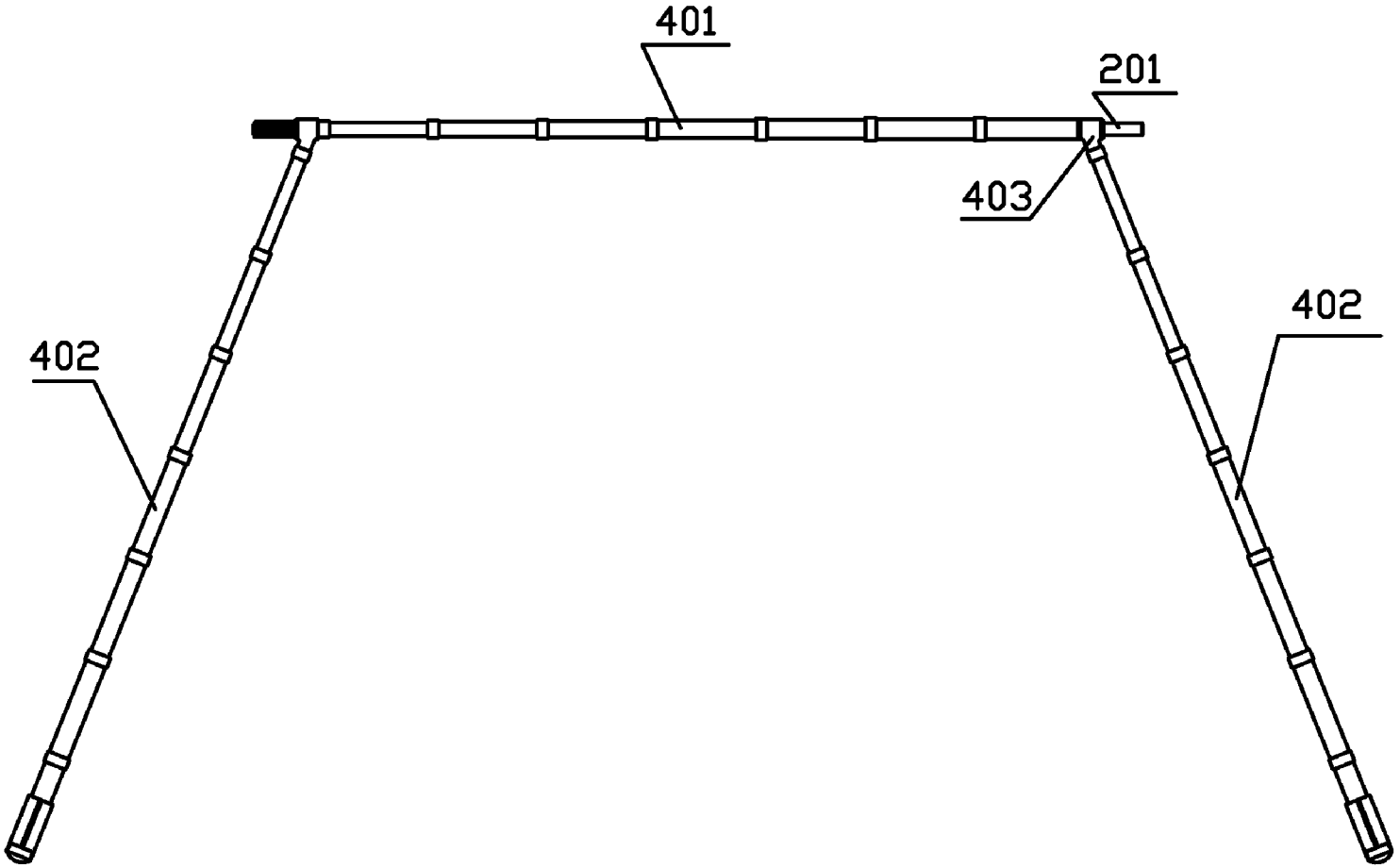
Figures 2, 3:
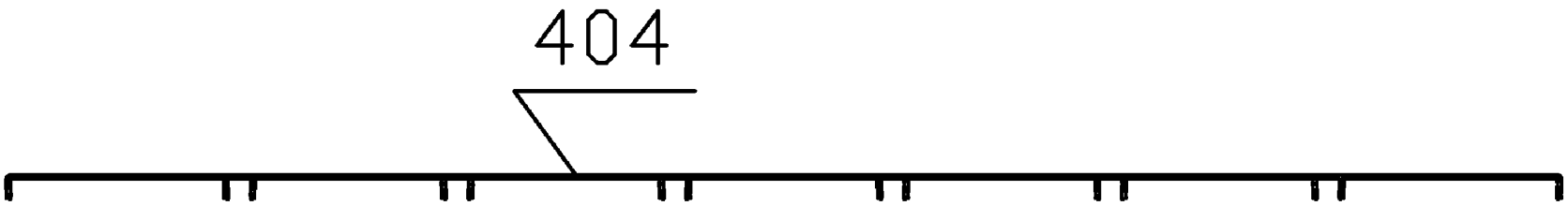
Figure 3:
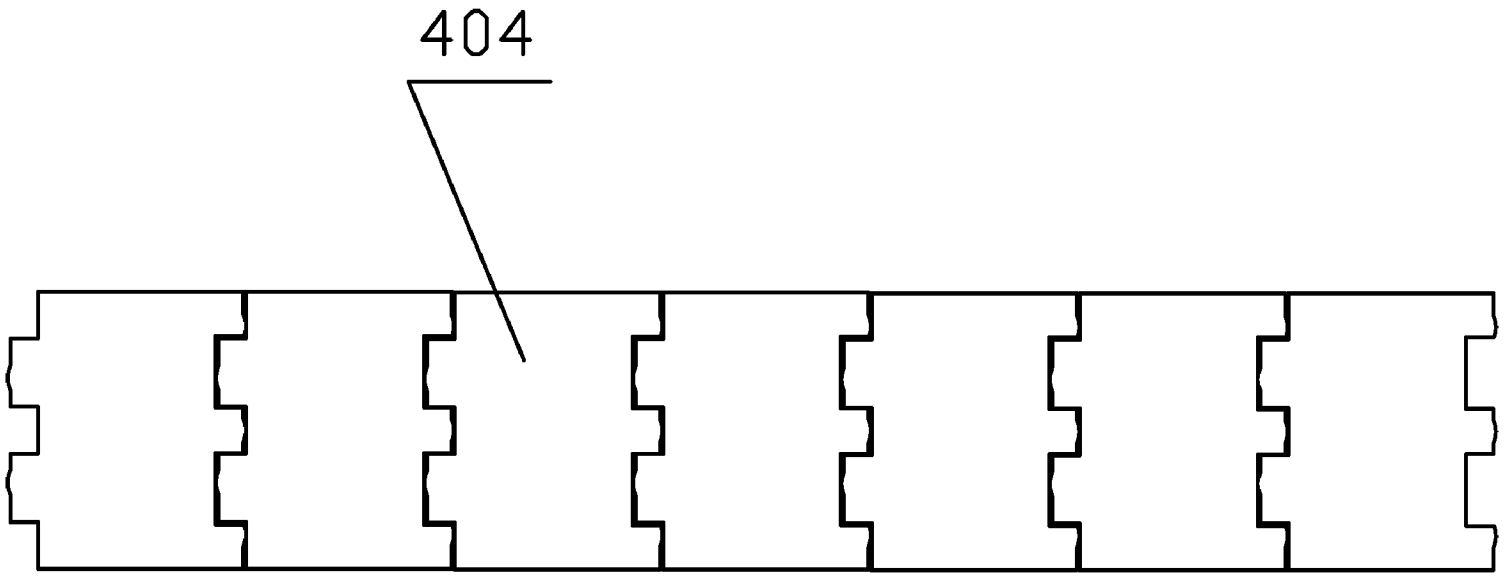
Figures 3, 4:
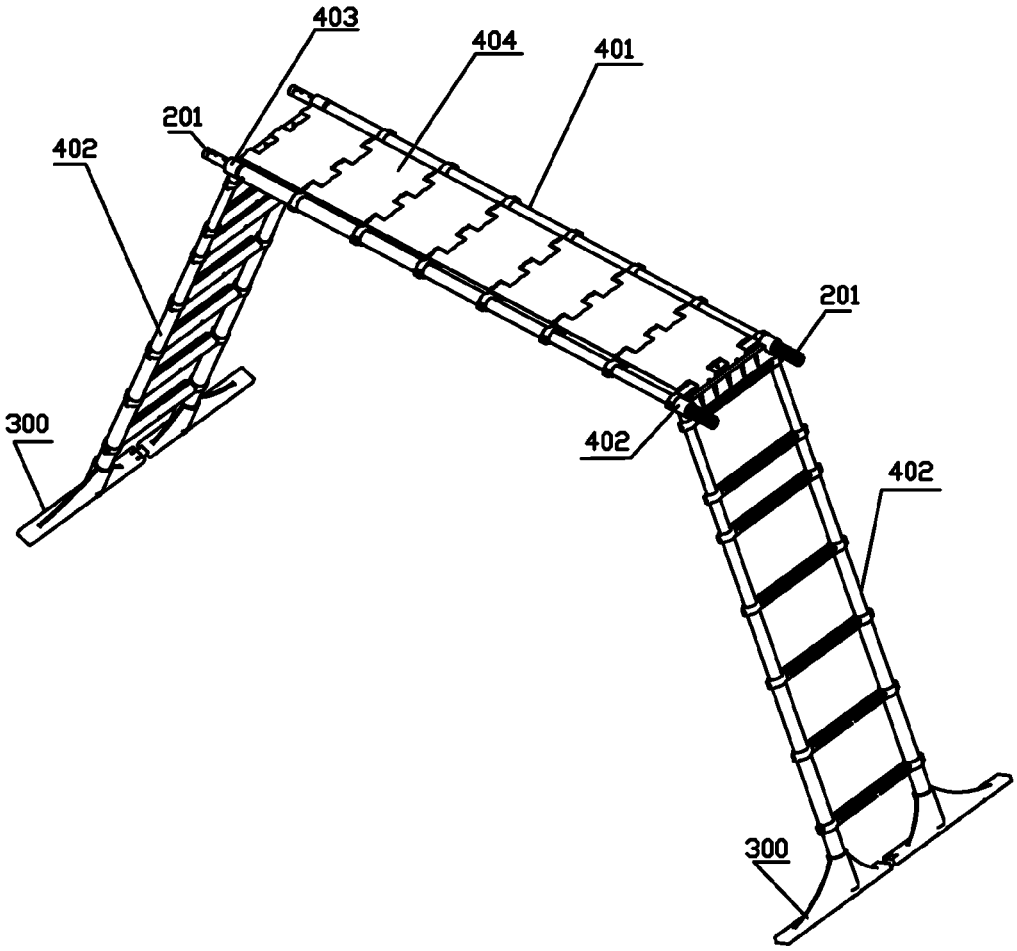
Figures 3, 4, 5:
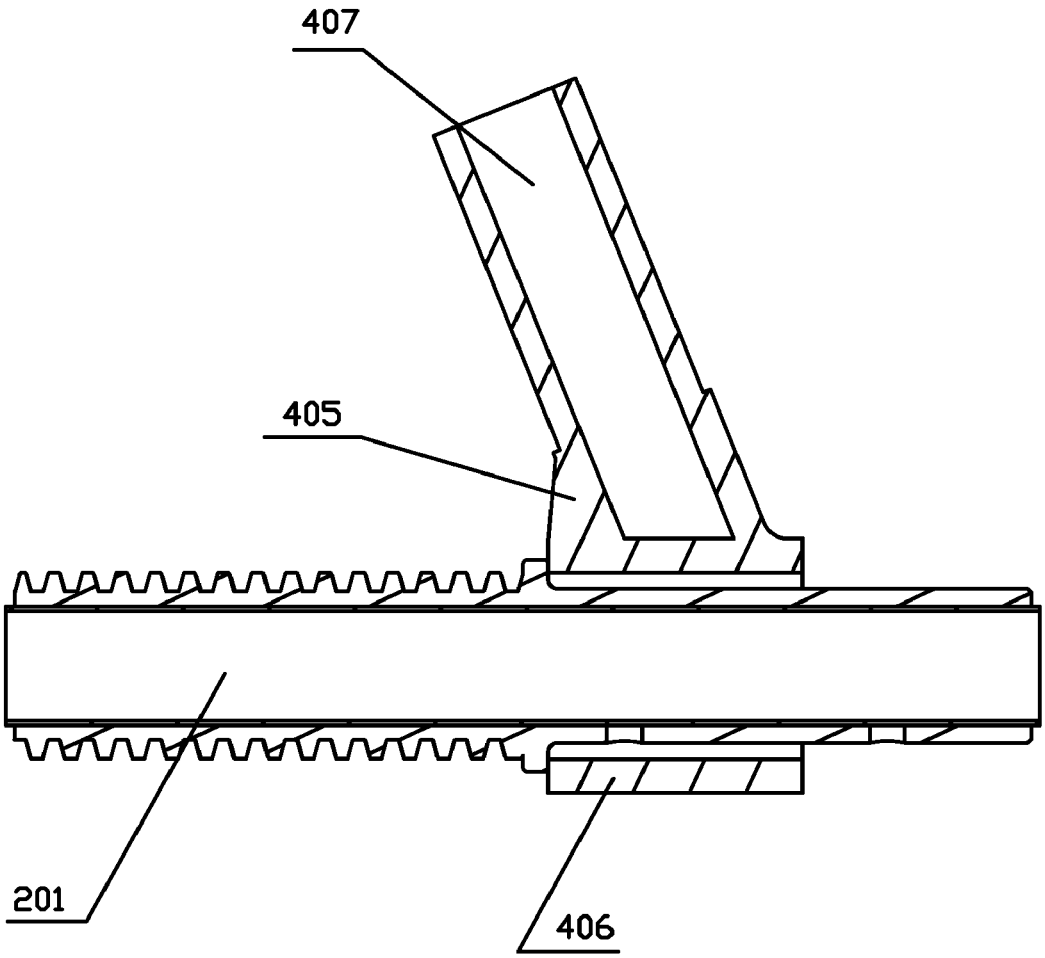

As shown in FIG. 5, a height of a ladder butt of the invention can be varied by adjusting the spiral ladder butt 600. As the spiral ladder butt 600 rotates one circle clockwise or counterclockwise, a height of the ladder is increased or decreased by a screw pitch. This can be applied to a condition where a height of only one ladder section or a leg is required.

In other embodiments, a pair of spiral ladder butts 600, antiskid ladder butts, or widening ladder butts 300 is disposed at the bottom of the columns of downmost extension ladders of the legs.

Figures 3, 4, 5, 6:
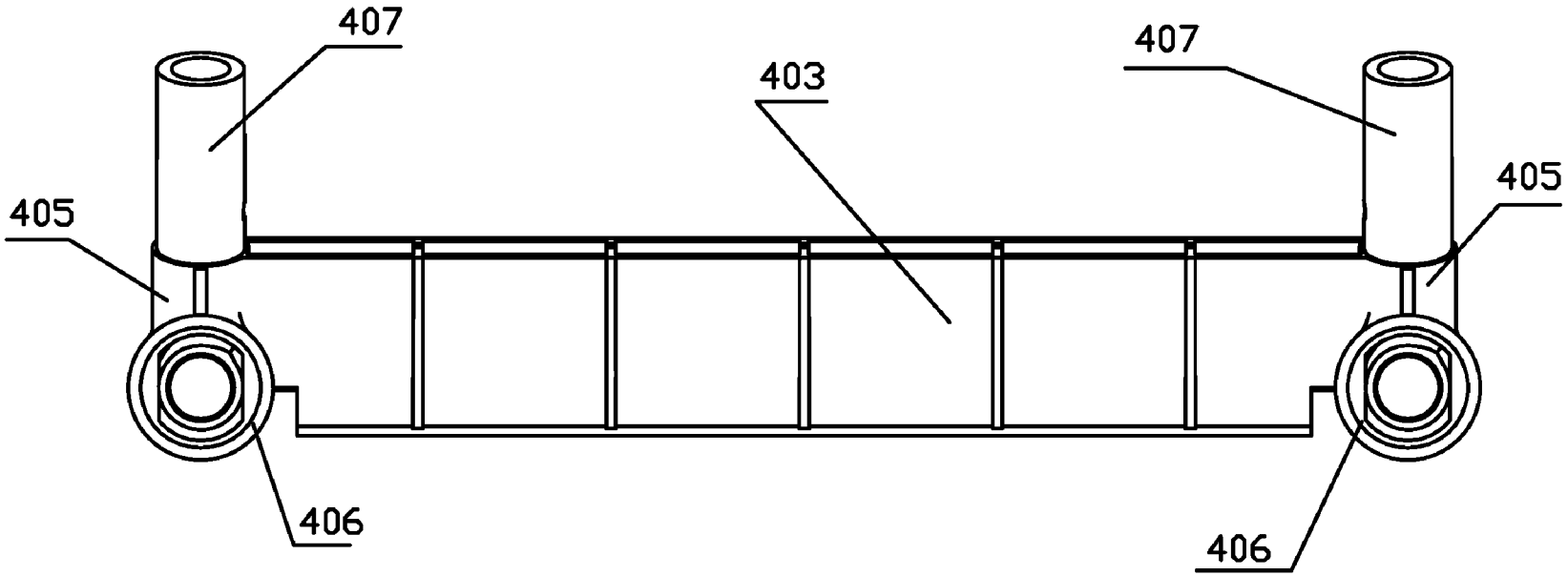
Figures 1, 4:
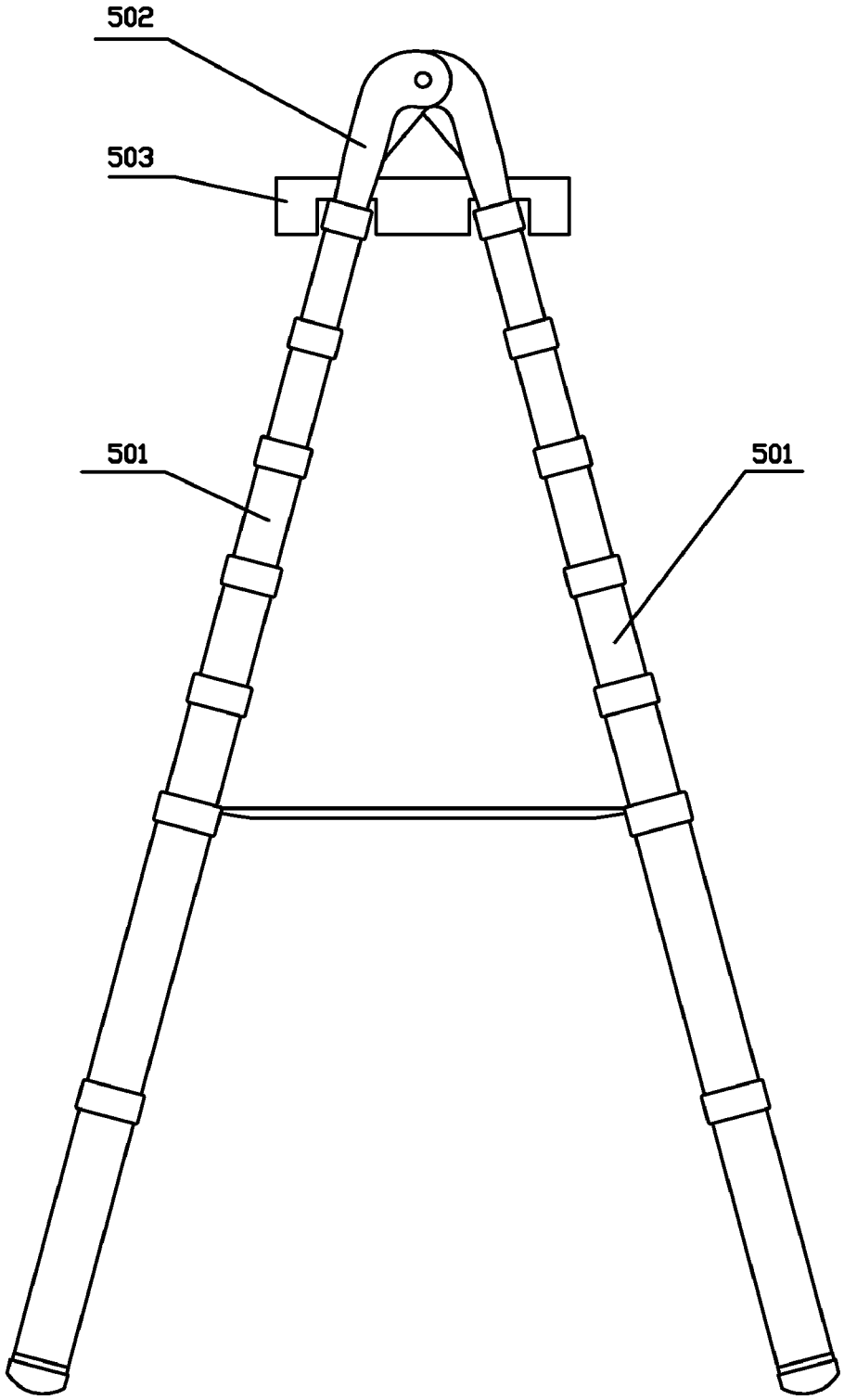
Figures 2, 4:
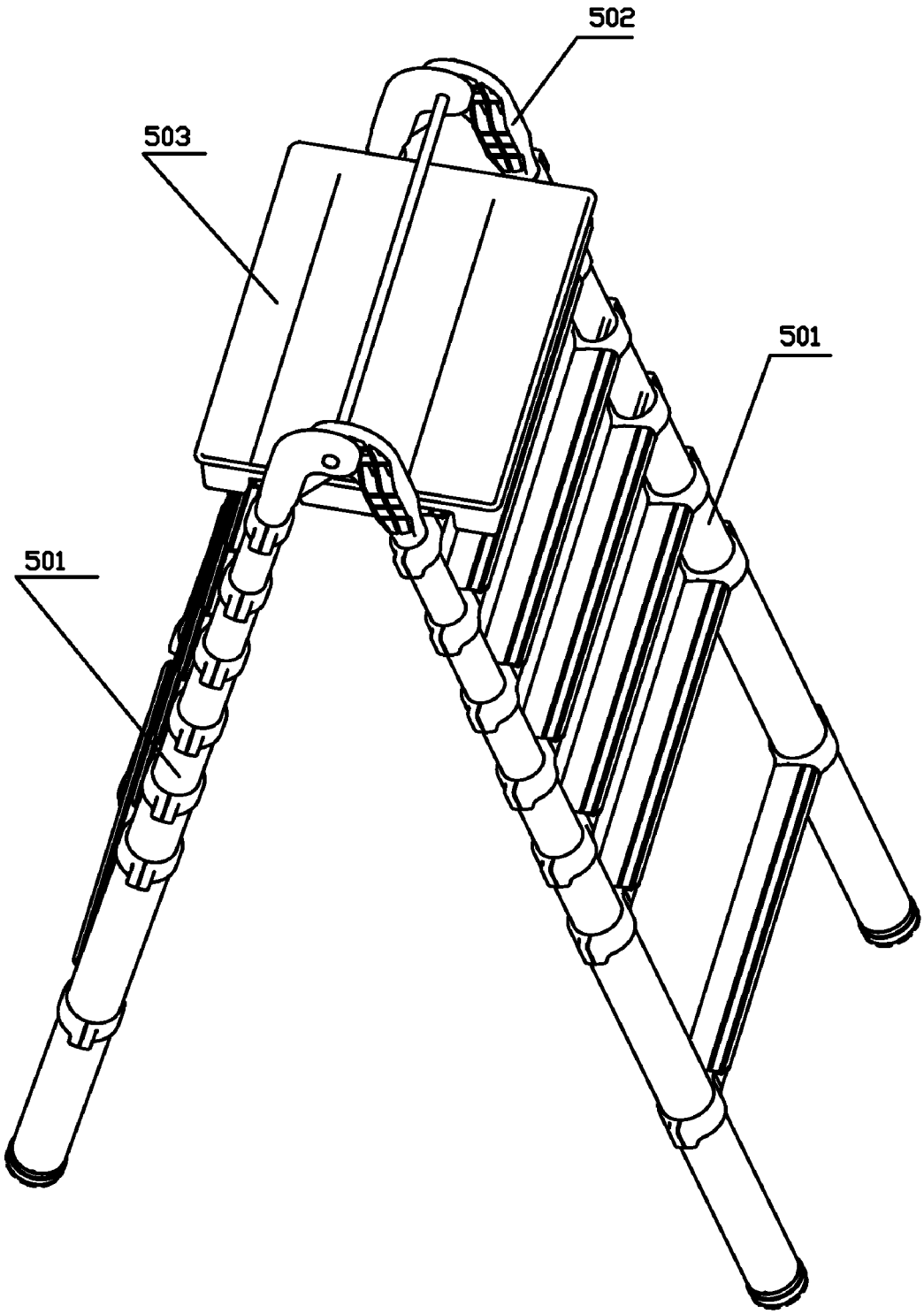
Figures 1, 5:
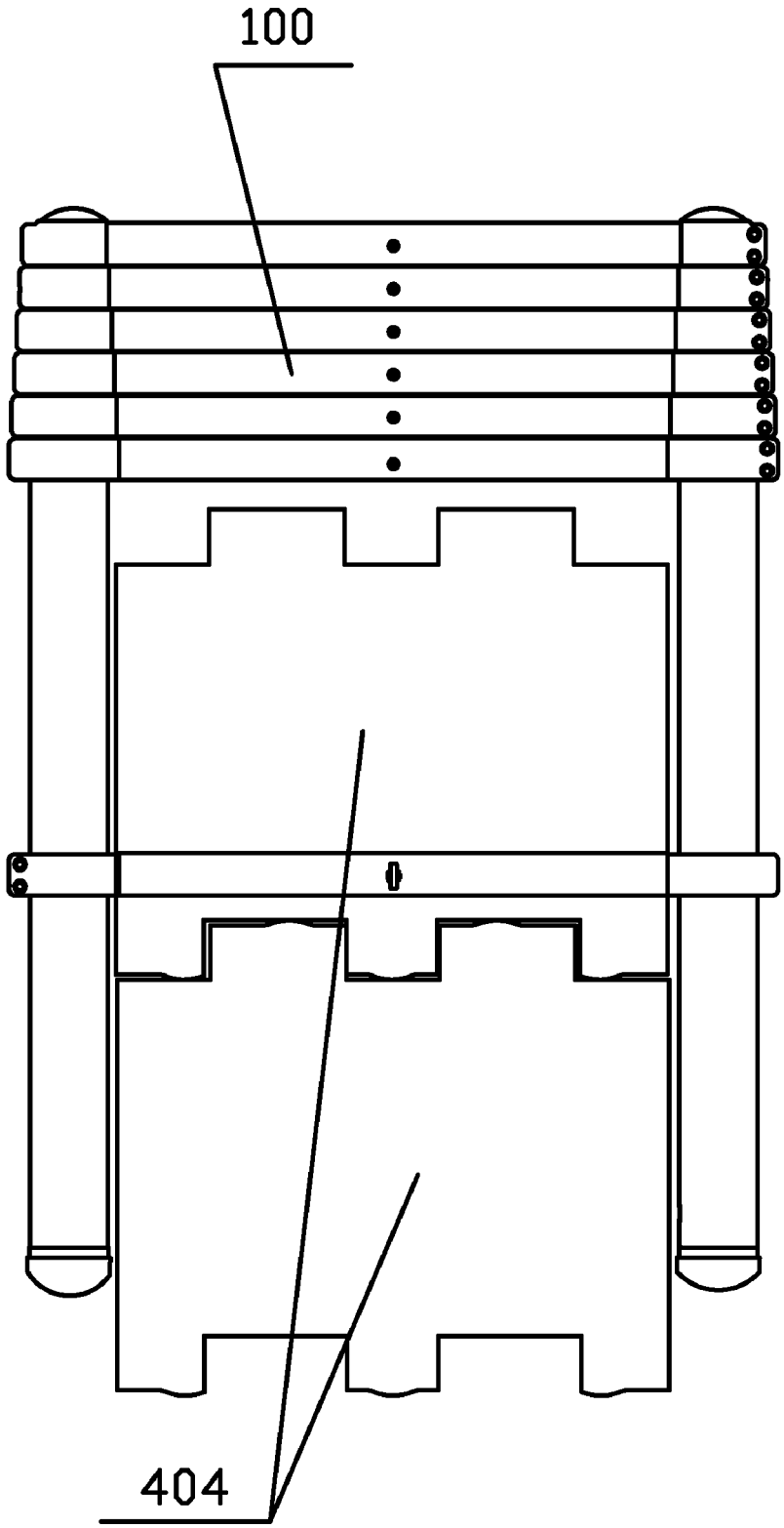
Figures 2, 5:
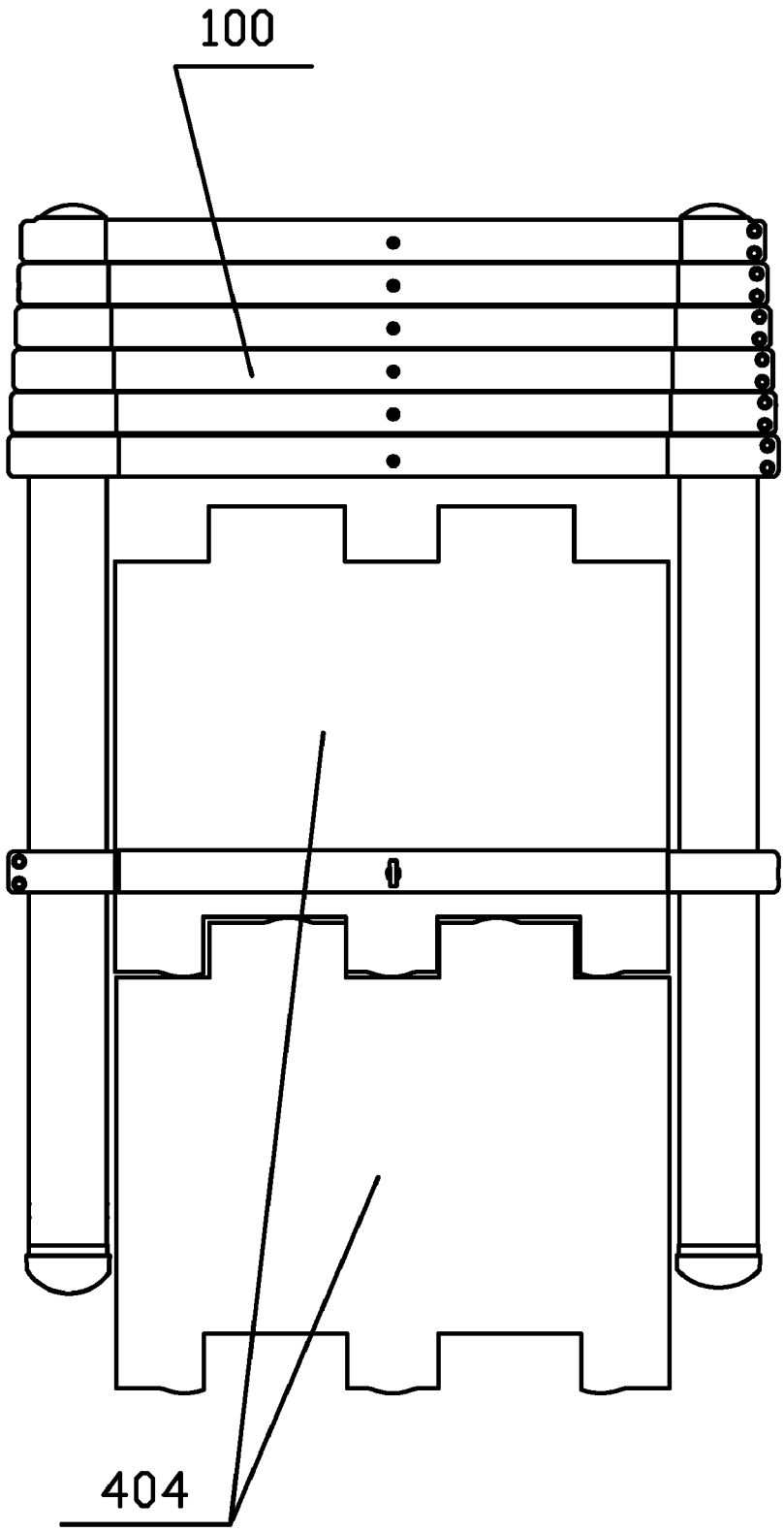
Figures 3, 5:
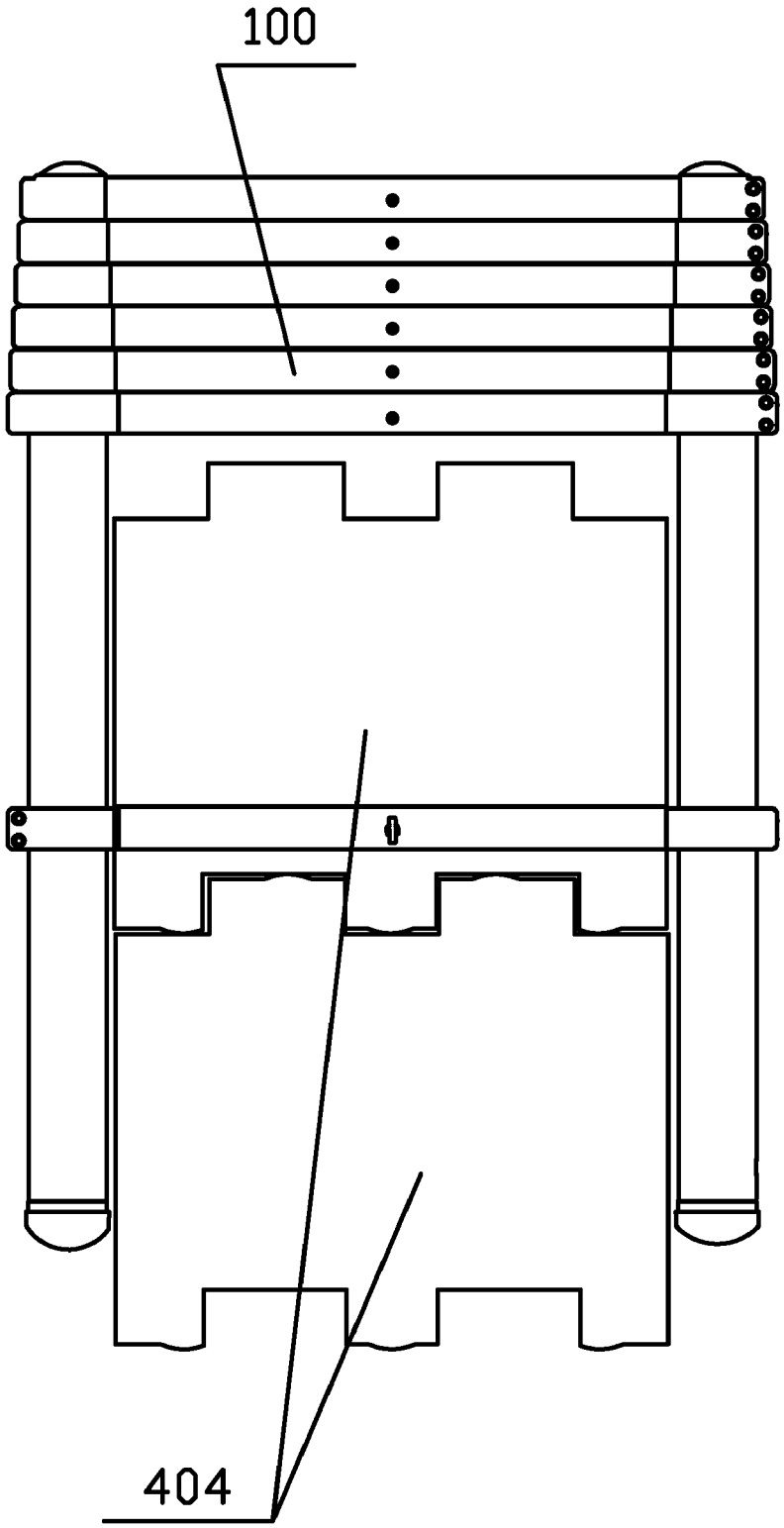
Figures 4, 5:
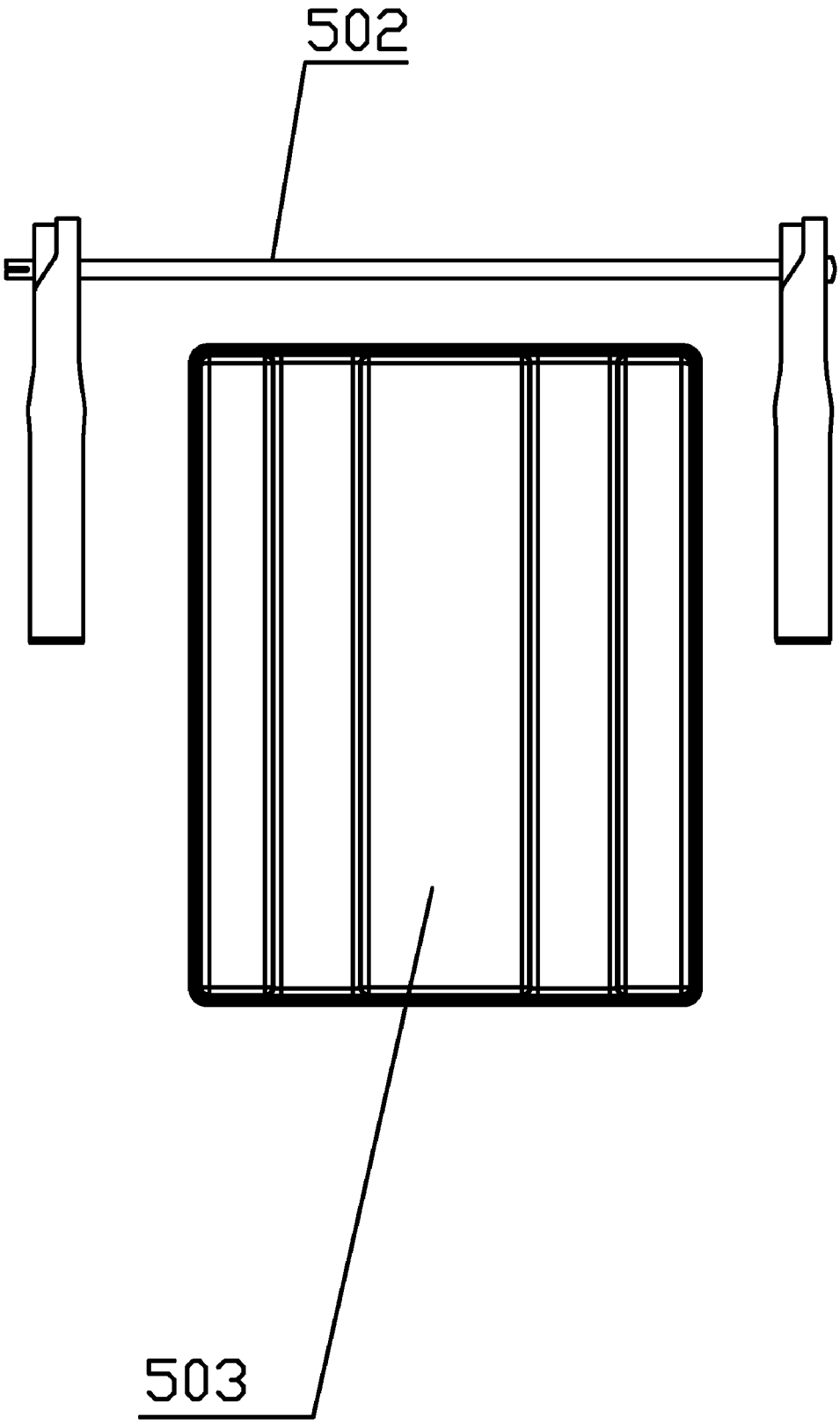
Figure 5:
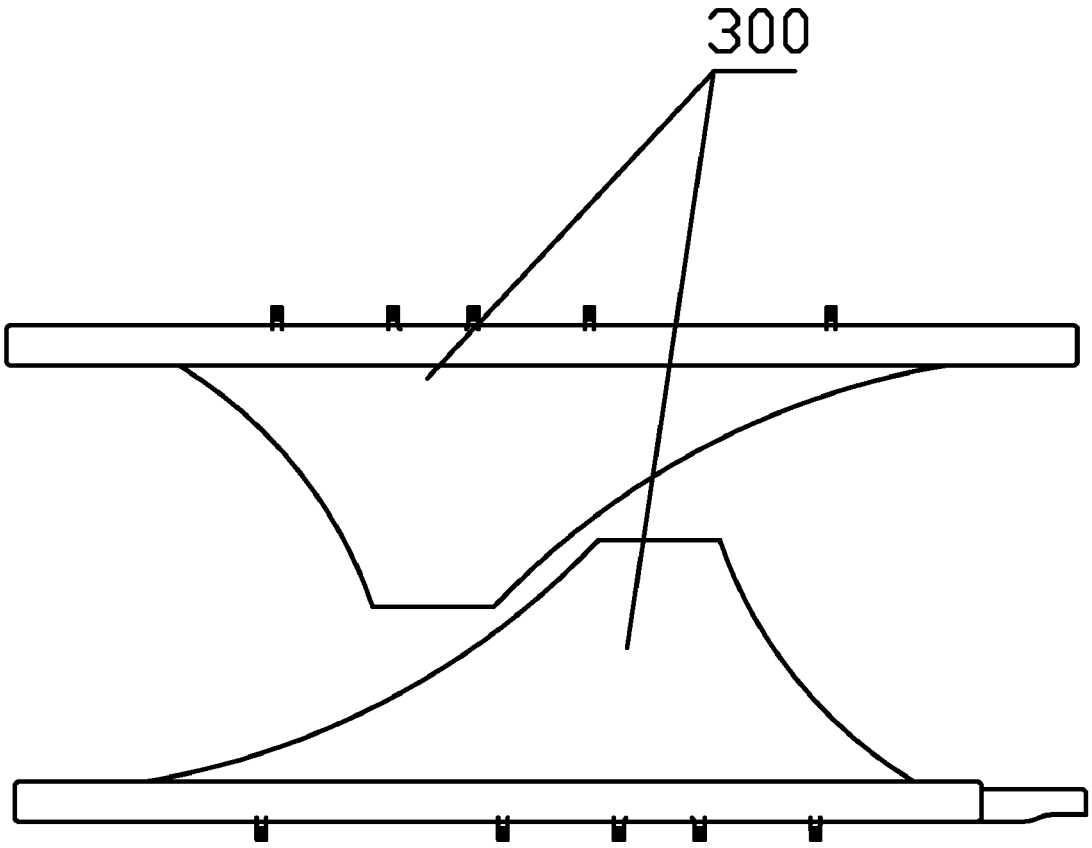
Figures 5, 6:
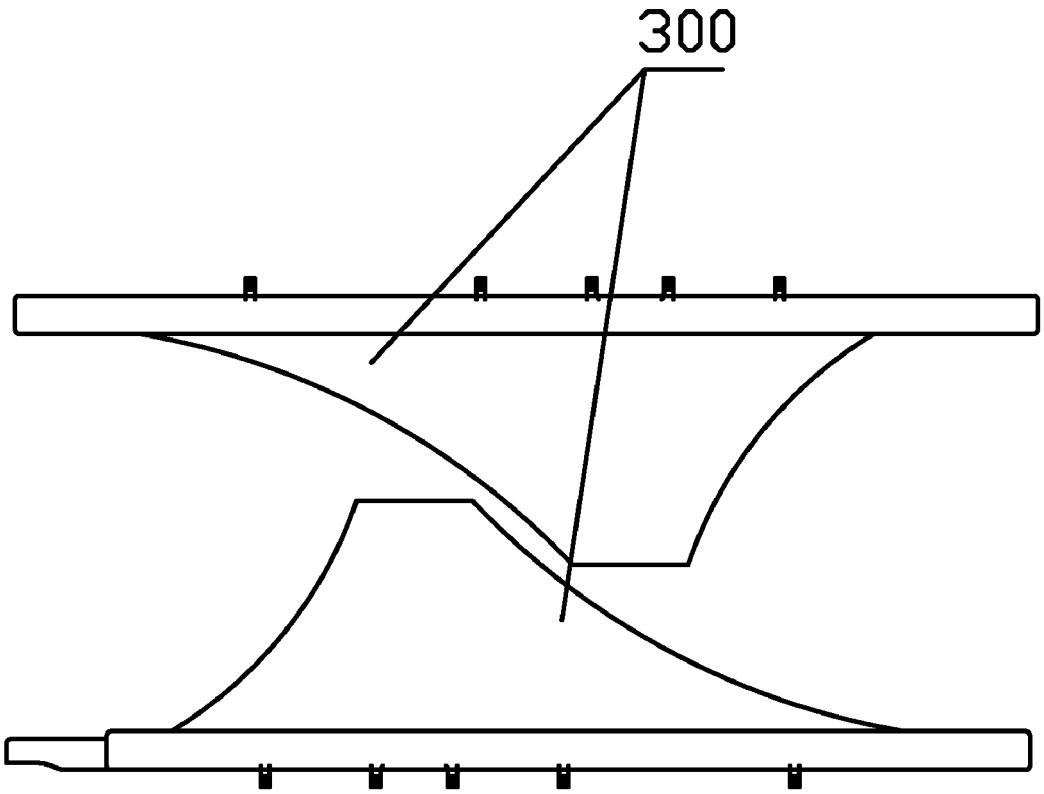
Figures 5, 6, 7:
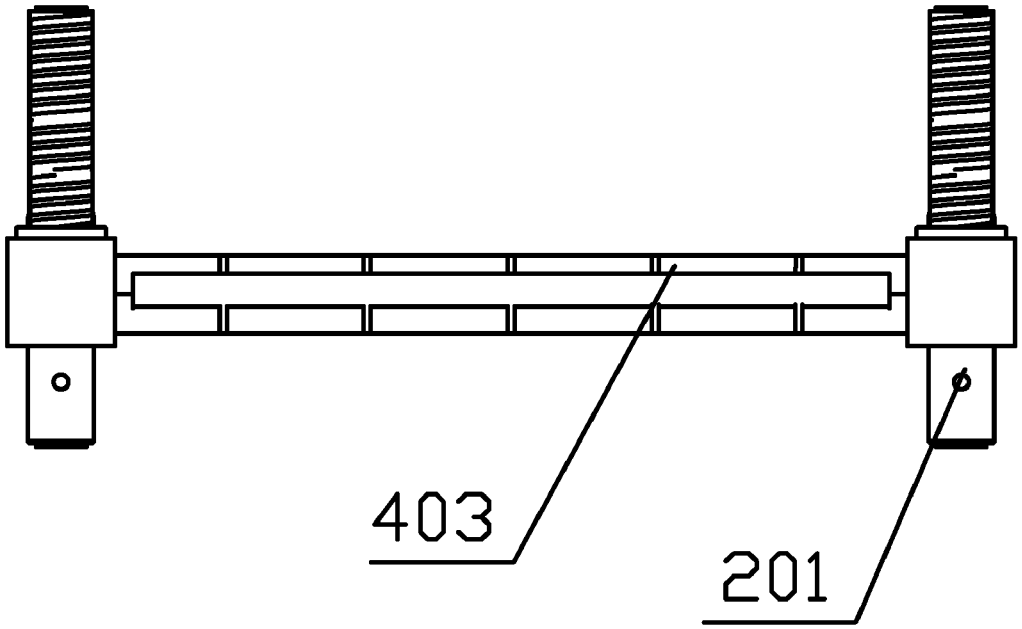
Figures 5, 6, 7, 8:
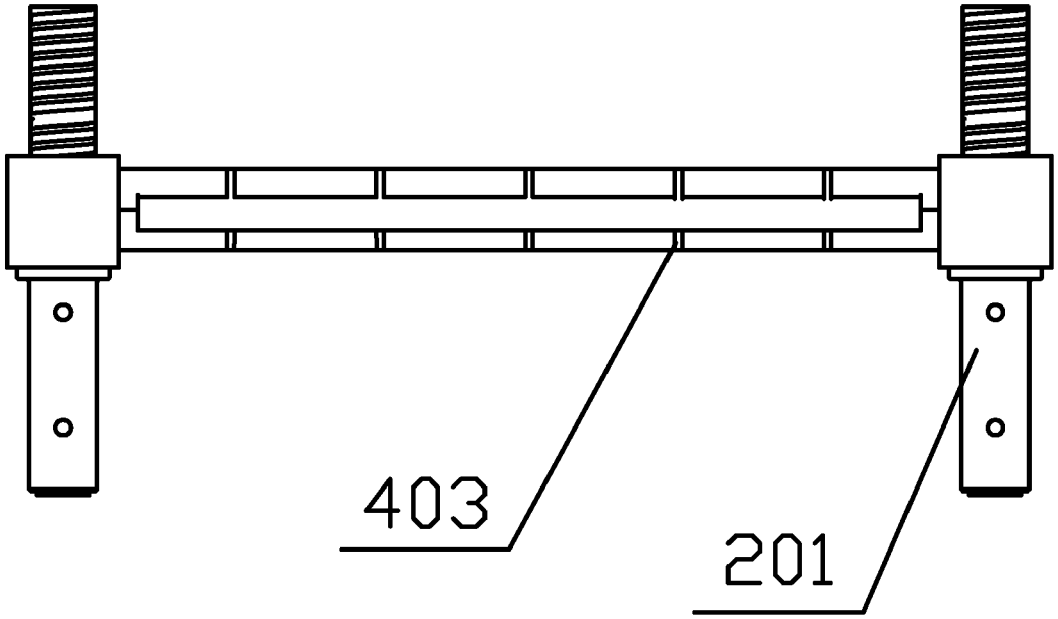
Figure 6:
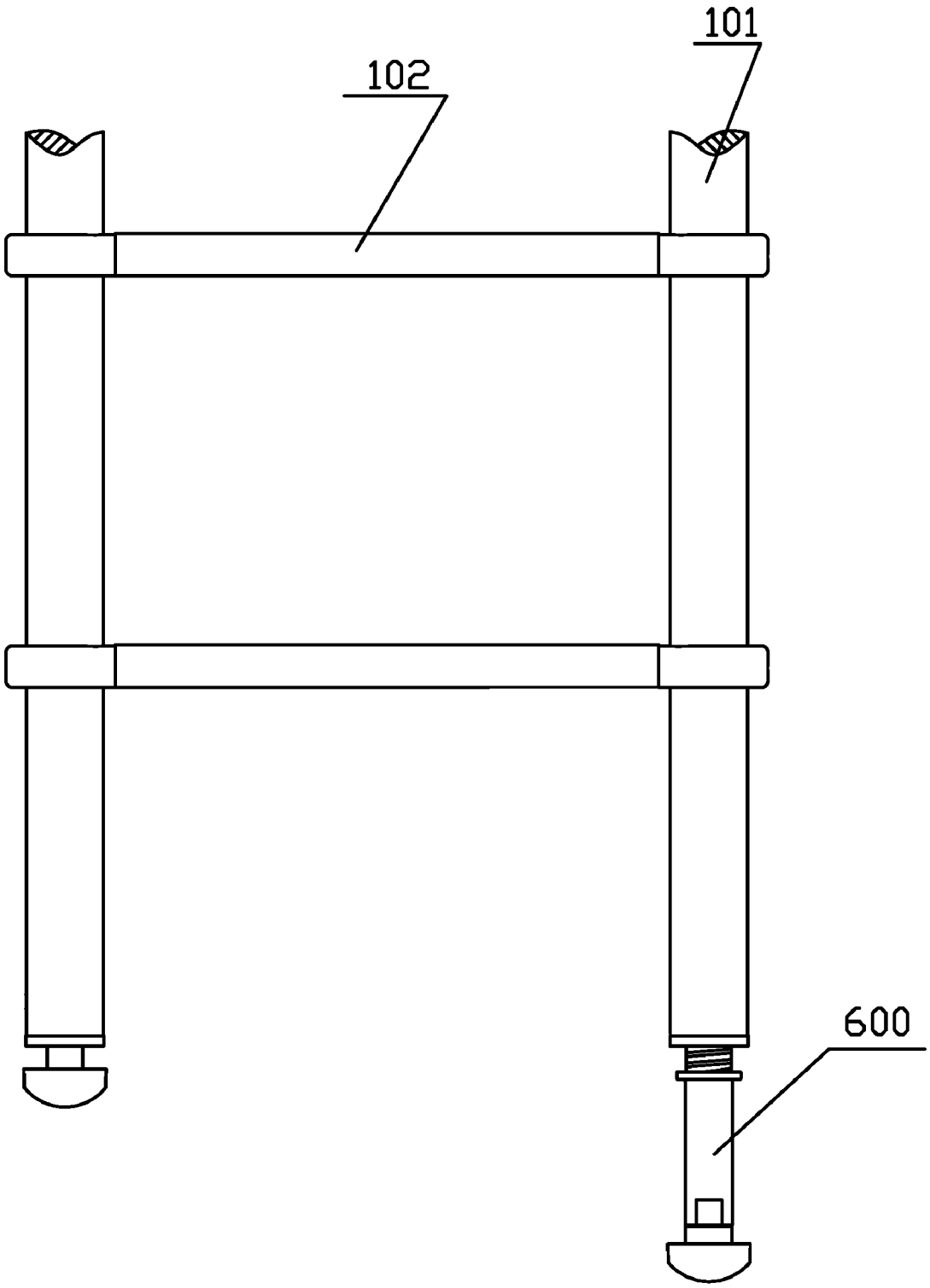

As shown in FIG. 6, other accessories, such as multiple pedals 404, a hinge 502, a connecting shaft 201, a supporting plate 503, a beam 403, a widening ladder butt 300, an antiskid ladder butt 600, and a key can be added to three extension ladders 100, whereby forming different combined extension ladders or step ladders. The ladder occupies small space, and can be received by two normal-sized suitcases (800×600×200 mm) after being retracted, which make the invention convenient for construction, transportation, storage and carrying.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An extension ladder, comprising multiple ladder sections, each comprising
- a pair of pin holes
- a pair of columns; and
- a rung, comprising
  - a pair of pins;
  - a pair of springs;
  - a gear;
  - a pair of gear racks; and
  - a pair of mounting rings;

wherein
- said columns of adjacent ladder sections are fit with each other;
- diameters of said columns of said ladder sections increase from the top to the bottom;
- said pin holes are disposed on said columns, and operate to receive said pins;
- said pins are coaxial;
- said gear is disposed on a side wall of said rung and engaged with said gear rack;
- one end surface of said gear sticks out from the side wall of said rung;
- a key hole is disposed on the end surface of said gear;
- said mounting ring operates to fix said pin; and
- said spring is contacted with said pin.

2. The extension ladder of claim 1, wherein said gear racks drive said pins to move as said gear rotates.

3. An extension ladder, comprising multiple ladder sections, each comprising
- a pair of pin holes;
- a pair of columns; and
- a rung, comprising
  - a pair of pins;
  - a pair of springs;
  - a wheel;
  - a pair of soft belts; and
  - a pair of mounting rings;

wherein
- said columns of adjacent ladder sections are fit with each other;
- diameters of said columns of said ladder sections increase from the top to the bottom;
- said pin holes are disposed on said columns, and operate to receive said pins;
- said pins are coaxial;
- one end of said soft belt is disposed on said wheel;
- said mounting ring is disposed on the other end of said soft belt and operates to fix said pin;
- said wheel is disposed on a side wall of said rung;
- one end surface of said wheel sticks out from the side wall of said rung;
- a key hole is disposed on said wheel; and
- said spring is contacted with said pin.

4. The extension ladder of claim 3, wherein said soft belts drive said pins to move as said wheel rotates.

5. A combined extension ladder, comprising
- multiple extension ladders, comprising multiple ladder sections, each comprising
  - a pair of pin holes;
  - a pair of columns; and
  - a rung, comprising
    - a pair of pins;
    - a pair of springs;
    - a gear;
    - a pair of gear racks; and
    - a pair of mounting rings;
- multiple connecting shafts;

wherein
- said columns of adjacent ladder sections are fit with each other;
- diameters of said columns of said ladder sections increase from the top to the bottom;
- said pin holes are disposed on said columns, and operate to receive said pins;
- said pins are coaxial;
- said gear is disposed on a side wall of said rung and engaged with said gear rack;
- one end surface of said gear sticks out from the side wall of said rung;
- a key hole is disposed on the end surface of said gear;
- said mounting ring operates to fix said pin;
- said spring is contacted with said pin; and
- adjacent extension ladders are connected to each other by threaded-connecting said columns to said connecting shafts.

6. A combined extension ladder, comprising
- multiple extension ladders, comprising multiple ladder sections, each comprising
  - a pair of pin holes;
  - a pair of columns; and
  - a rung, comprising
    - a pair of pins;
    - a pair of springs;
    - a wheel;
    - a pair of soft belts; and
    - a pair of mounting rings;
- multiple connecting shafts;

wherein
- said columns of adjacent ladder sections are fit with each other;
- diameters of said columns of said ladder sections increase from the top to the bottom;
- said pin holes are disposed on said columns, and operate to receive said pins;
- said pins are coaxial;
- one end of said soft belt is disposed on said wheel;
- said mounting ring is disposed on the other end of said soft belt and operates to fix said pin;
- said wheel is disposed on a side wall of said rung;
- one end surface of said wheel sticks out from the side wall of said rung;
- a key hole is disposed on said wheel;
- said spring is contacted with said pin; and
- adjacent extension ladders are connected to each other by threaded-connecting said columns to said connecting shafts.

* * * * *